US006167814B1

(12) United States Patent
Sugimoto et al.

(10) Patent No.: US 6,167,814 B1
(45) Date of Patent: Jan. 2, 2001

(54) RUNNING STABILIZING LINKAGE SYSTEM FOR THE JOINT OF COACHES

(75) Inventors: Yoshitaka Sugimoto; Kozo Ueta; Masanori Shinya, all of Osaka (JP)

(73) Assignee: Kinki Sharyo Co., Ltd., Osaka Prefecture (JP)

( * ) Notice: Under 35 U.S.C. 154(b), the term of this patent shall be extended for 0 days.

(21) Appl. No.: 09/222,693

(22) Filed: Dec. 29, 1998

(30) Foreign Application Priority Data

May 27, 1998 (JP) ..... 10-145746

(51) Int. Cl.[7] ..... B60D 7/00

(52) U.S. Cl. ..... 105/3; 105/4.1; 105/8.1; 280/400

(58) Field of Search ..... 105/3, 392.5, 4.1, 105/8.1; 280/400, 403, 408, 432; 180/235

(56) References Cited

U.S. PATENT DOCUMENTS 4,473,127 * 9/1984 Faust et al. ..... 280/408
5,197,392 * 3/1993 Jeunehomme ..... 105/3
5,372,073 * 12/1994 Cattani ..... 105/3
5,377,597 * 1/1995 Richter et al. ..... 105/4.1
5,953,997 * 9/1999 Andre et al. ..... 105/4.1

* cited by examiner

*Primary Examiner*—S. Joseph Morano
*Assistant Examiner*—Lars A. Olson
(74) *Attorney, Agent, or Firm*—Vedder Price Kaufman & Kammholz

(57) ABSTRACT

The running stabilizing linkage system of the invention, which is applicable to the joints of a 3-coach articulate car essentially consisting of a front coach, a rear coach and an intermediate coach which is comparatively short, comprises a link holder 2 disposed rotatably about a vertical axis in the center in plan view of the intermediate coach, a pair of connecting rods 4, 4 each connected to the link holder through a bearing 7, with the connecting rods being supported rotatably about vertical axes in positions radially equi-spaced from the center of the link holder, and a pair of link brackets 3, 3 each disposed in the transverse center of the end of the front or near coach which is closer to the intermediate coach, with the other end of each connecting rod being connected rotatably about a vertical axis to the corresponding link bracket 3 through a bearing 8. This linkage prevents jolt of the car, particularly pitching of the intermediate coach.

5 Claims, 9 Drawing Sheets

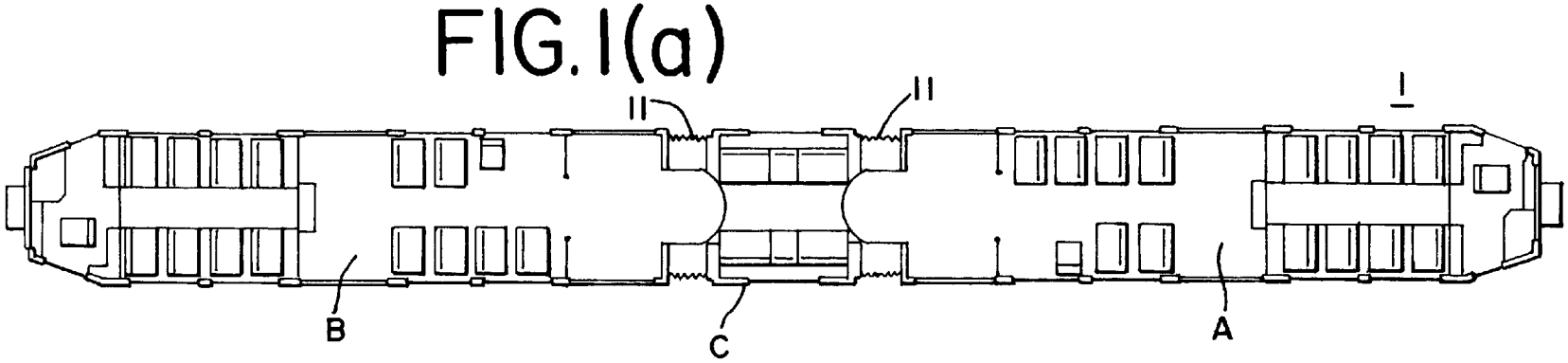
FIG. I(a)
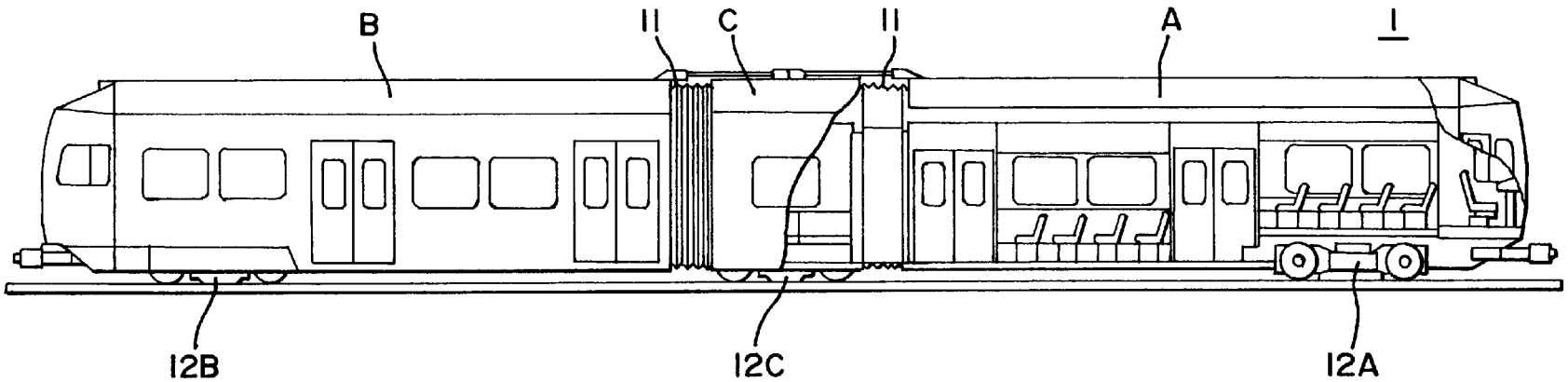
FIG. I(b)

A
B
C
2
3
4
7
8
10
2(c)

7
72
73
75
74
76
74a
76
71

72
71

43
41
42
42a 4
45b
45a
45c
43
41
42
42a

RUNNING STABILIZING LINKAGE SYSTEM FOR THE JOINT OF COACHES

BACKGROUND OF THE INVENTION

1. Field of the Invention

The present invention relates to a running stabilizing linkage system for the joints of an articulated car consisting of 3 coaches each having only one underframe, with front and rear coaches B, A interconnected by a relatively short intermediate coach C, which system is designed to prevent jolt of the car, particularly pitching of coach C.

2. Description of the Related Art

Among lightweight railroad cars such as streetcars which are represented by the two-coach articulated car, there is a car such that its front coach B and rear coach A are interconnected by an articular structure supported on an underframe. While coach B has an underframe only at its front part, coach A has an underframe only at its rear part, and the two coaches B and A are held in a horizontal position by the underframe disposed at the joint. Thus, in such a 3-coach, low-floor articulated car, the coaches are balanced in a horizontal position on the three underframes.

However, the conventional 3-coach, low-floor articulated car has the disadvantage that the jolt of the car, particularly pitching (jolt due to rotation about a transverse axis) of coach C, is inevitable, with the result that the comfort of passengers taking the seats in coach C is adversely affected.

The present invention, therefore, has for its object to provide a "running stabilizing linkage system for the joints of coaches" which prevents jolt of a car, particularly pitching of coach C when applied to the joints of an articulated car such that its front and rear coaches are interconnected by a comparatively short intermediate coach C.

SUMMARY OF THE INVENTION

To overcome the above disadvantages, the running stabilizing linkage system of the present invention for the joints of a 3-coach articulated car of such a type that its front and rear coaches are interconnected by a comparatively short coach C comprises a link holder disposed in the center in plan view of the coach C in such a manner that it may rotate about a vertical axis, connecting rods with one ends thereof connected to said link holder in radially equi-spaced positions from the center of said link holder in such a manner that said respective ends of connecting rods are rotatable each about a vertical axis, and link brackets disposed in transversely central positions at the ends of said front and rear coaches which are closer to said coach C in such a manner that the other end of each connecting rod may be rotatable about a vertical axis.

As a preferred embodiment, the present invention relates to a running stabilizing linkage system which, in addition to the above construction, is further characterized in that said link holder is rotatably supported by a ball bearing on top of coach C, with each transverse side of said link holder being connected to one end of the corresponding connecting rod through a spherical bearing and the other end of said connecting rod being connected through a spherical bearing to the link bracket disposed at the top of the end portion of the front or rear coach which is closer to said coach C.

More preferably, the present invention provides a running stabilizing linkage system which, in addition to either of the above constructions, is further characterized in that said car is a low-floor-level articulated car.

With the running stabilizing linkage system according to the present invention, jolt of the car, particularly pitching of coach C, can be prevented.

BRIEF DESCRIPTION OF SEVERAL VIEWS OF THE DRAWING

FIG. 1 shows an articulated car equipped with the running stabilizing linkage system according to a preferred embodiment of the invention, wherein (*a*) is a transverse cross-section view and (*b*) is a side elevation view in partial section.

DETAILED DESCRIPTION OF THE PREFERRED EMBODIMENTS

The running stabilizing linkage system for the joint between coaches according to the present invention is now described in detail.

FIG. 1 shows a typical railroad car equipped with a running stabilizing linkage system embodying the present invention, wherein (*a*) is a cross-section view and (*b*) is a side elevation view in partial section.

This railroad car 1 is a low-floor-level articulated car consisting of a front coach B, a rear coach A, and an intermediate coach C interconnecting said front and reach coaches A, B. The longitudinal dimension of coach C is considerably smaller than that of coaches B, A and a rubber cushion coupler comprising a bellows-like rubber element 11 is interposed each between coaches B and C and between coaches C and A. Coach B has an underframe 12B only in its front end part while coach A has an underframe 12A only in its rear end part, and those coaches B and A are held in a horizontal position by an underframe 12C disposed under coach C.

In this specification, the lengthwise direction of the car is referred to as longitudinal, the widthwise direction of the car as transverse, and the heightwise direction of the car as vertical.

Figures 2A, 2B, 2C:
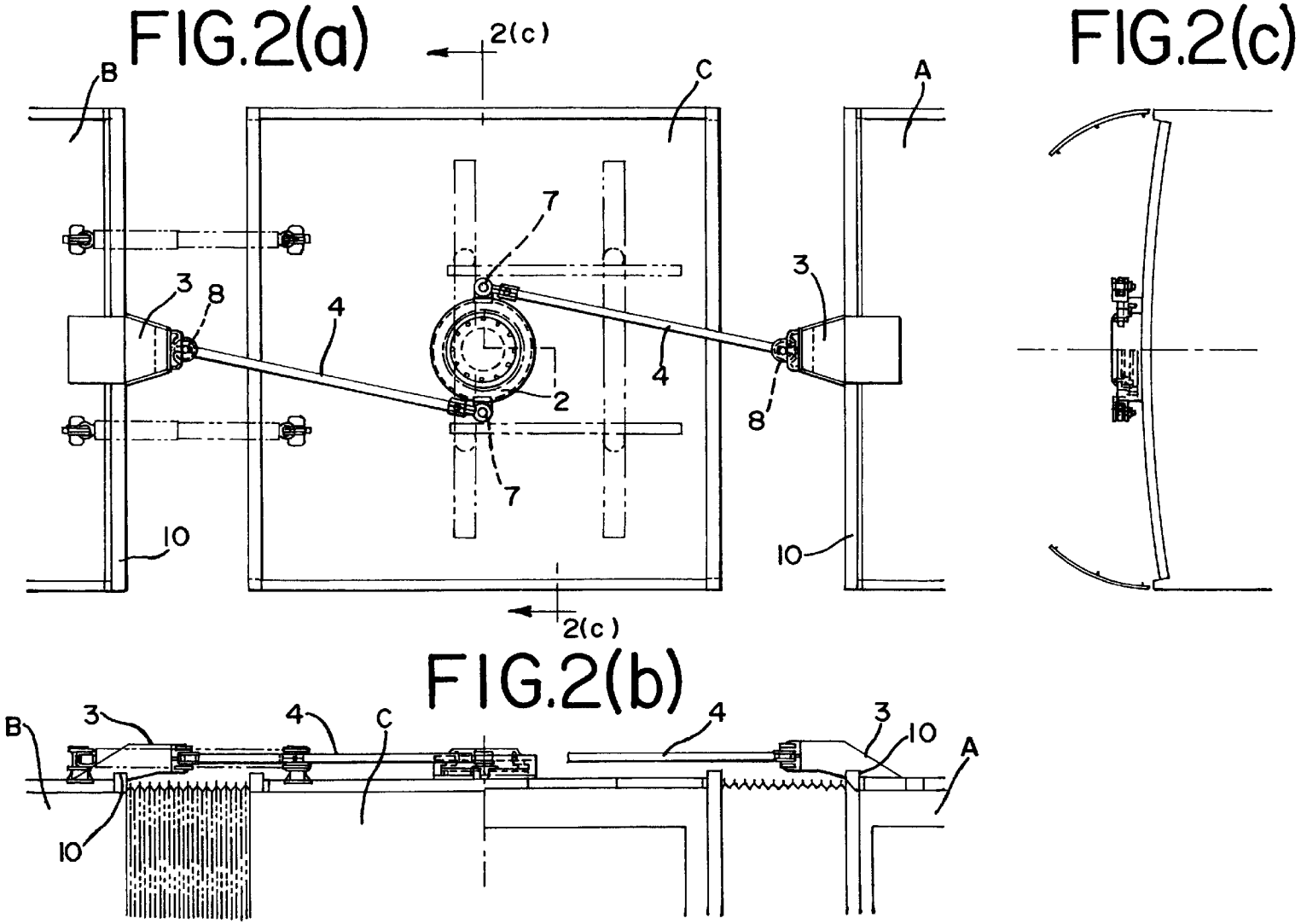
FIG. 2 shows an exemplary application of the running stabilizing linkage system according to the preferred embodiment of the invention to the coupling of coaches B and A through coach C, wherein (*a*) is a plan view, (*b*) is a side elevation view in partial section, and (C) is a cross-section view taken along the line A—A.
Figure 3A:
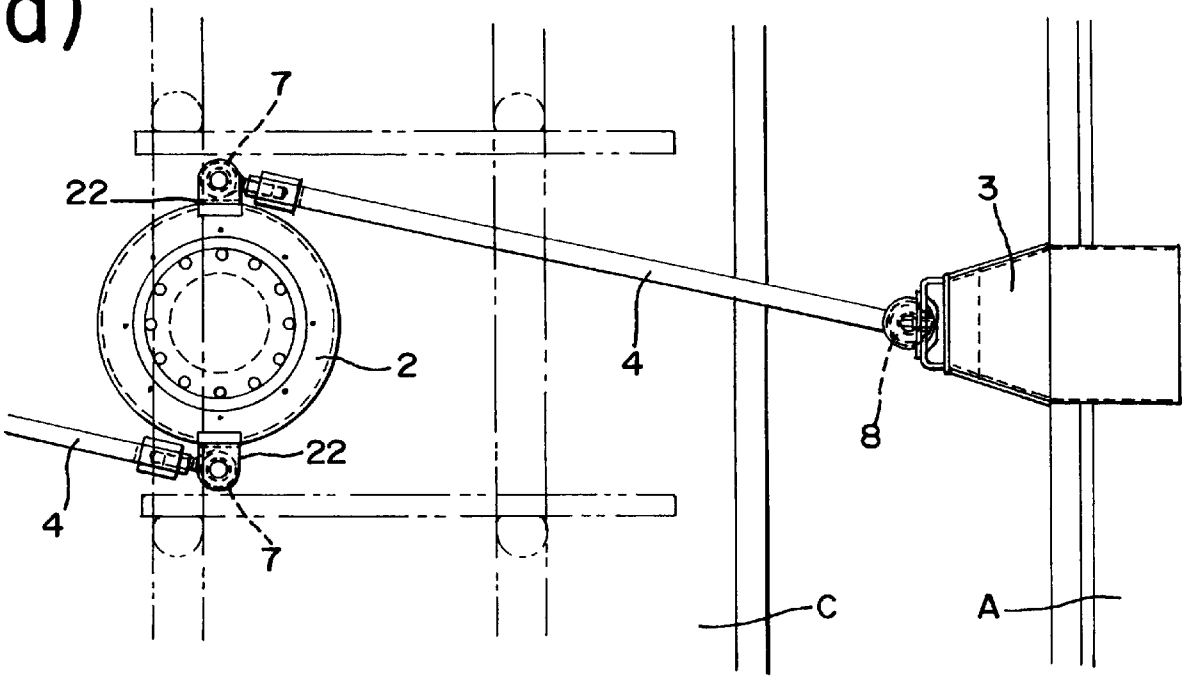
FIG. 3 shows the joint between coaches B and C in FIG. 2 on exaggerated scale, wherein (*a*) is a plan view and (*b*) is a side elevation view in partial section.
Figure 3B:
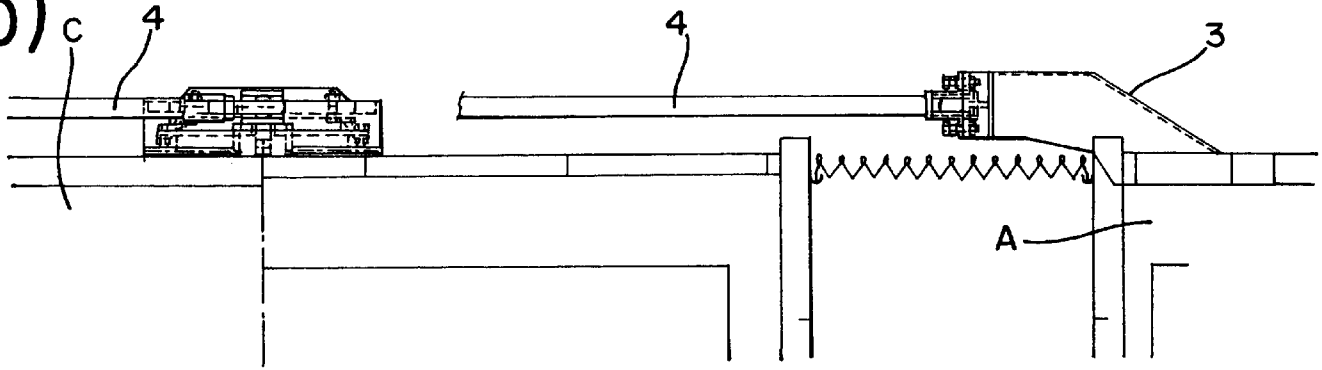

FIG. 2 shows the joints where coaches B and A are interconnected by coach C, wherein (*a*) is a plan view, (*b*) a side elevation view in partial section, and (*c*) a cross-section view taken along the line A—A. FIG. 3 shows the joint between coaches A and C, wherein (*a*) is a plan view and (*b*) is a side elevation view in partial section.

As shown in those several views of the drawing, the running stabilizing linkage system of the invention is installed on the roof of coach C with the links being disposed in a generally Z-configured arrangement between the rear end of coach B and the front end of coach A. Thus, the running stabilizing linkage system comprises a link holder 2 disposed rotatably about a vertical axis on the roof of coach C, a pair of link brackets 3, 3 disposed at the rear end of coach B and the front end of coach A, respectively, and a pair of connecting rods 4, 4 for connecting transverse edges of said link holder 2 to the corresponding link brackets 3, 3 through spherical bearings 7, 8, said link holder 2 and said pair of connecting rods 4, 4 forming a generally Z-configured linkage.

The running stabilizing linkage system is transversally symmetrical about the center of link holder 2. Thus, the connection between coaches B and C and the connection between coaches A and C are identical in construction except that one end of each connecting rod is connected to one transverse side of the link holder 2. Therefore, although the following description is made mostly with reference to the joint between coach A and coach C, the same applies to the joint between coach B and coach C.

Figure 4:
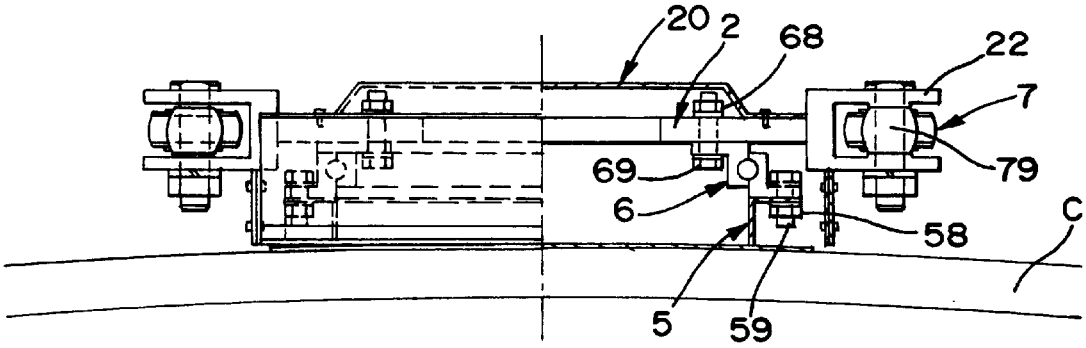
FIG. 4 is a view showing the principal part of FIG. 2(*c*) on exaggerated scale, indicating the manner of attachment of the link holder of the linkage system to coach C.

FIG. 4 is a view showing the principal part of FIG. 2(*c*) on exaggerated scale, indicating the manner of installation of link holder 2 on coach C.

The link holder 2 is disposed in the center, in plan view, of coach C, that is to say in the transversally and longitudinally central position of coach C.

The link holder 2 is mounted on a link support 5 on the roof of coach C in such a manner that it is rotatable through a ball bearing 6.

Figure 5A:
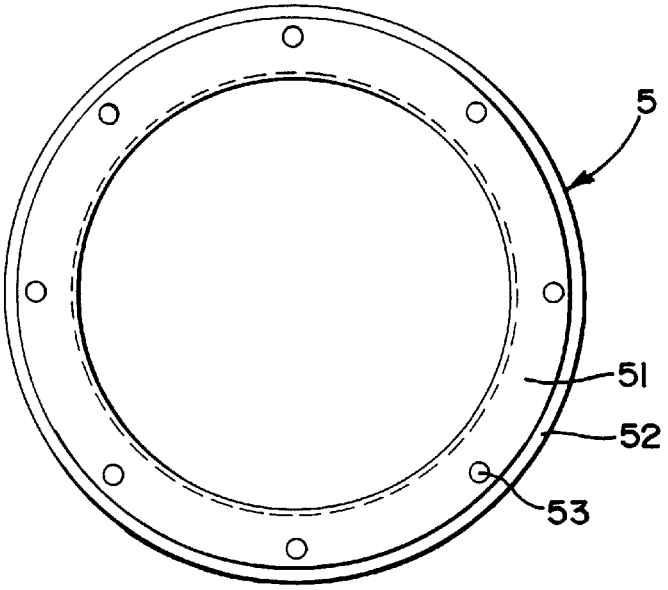
FIG. 5 shows the link support of the linkage system illustrated in FIG. 2, wherein (*a*) is a plan view and (*b*) is a front view.
Figure 5B:
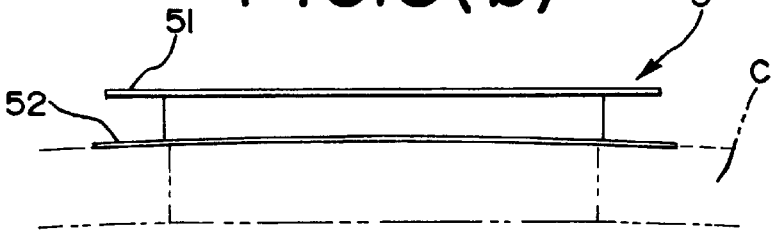

FIG. 5 shows the link support 5, wherein (*a*) is a plan view and (*b*) is a front view.

The link support 5 is a short, generally cylindrical element formed with flanges 51, 52 projecting radially outward from its top and bottom edges, respectively. The bottom flange 52 is slightly larger in diameter than the top flange 51.

The top flange 51 is provided with 8 bolt holes 53 extending vertically therethrough at equal circumferential pitches of 45 degrees.

The bottom surface of the link support 5 is curved to fit the roof of coach C. In this embodiment, the link support 5 is curved in the form of an arc with a radius of about 8 m in the transverse direction so that it may snugly rest on the top (roof surface) of coach C. On the other hand, the top surface of the link support 5 is horizontal and flat.

In the lower part of its peripheral wall, the link support 5 is formed with suitable drain holes. In this embodiment, 4 semicircular drain holes are provided at equal circumferential pitches of 90 degrees.

The link support 5 is rigidly mounted in the center, in plan view, of coach C by welding the peripheral part of the bottom flange 52 to the top of coach C.

Figure 6:
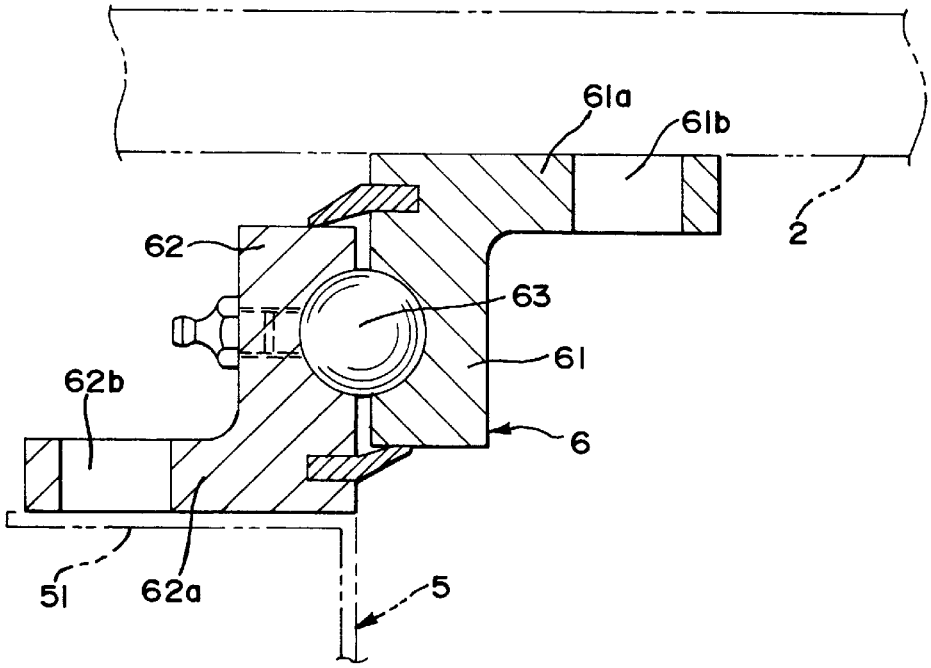
FIG. 6 is a longitudinal section view showing the ball bearing of the linkage system.

FIG. 6 is a longitudinal section view showing a ball bearing 6 to be disposed between the link support 5 and link holder 2.

The ball bearing 6 is a bearing means such that its inner ring 61 and outer ring 62 are rotatable with respect to each other through balls 63.

The lower end of the outer ring 62 is integrally formed with a flange 62*a* projecting out radially and this flange 62*a* is rigidly secured to the top flange 51 of the link support 5. Thus, the flange 62*a* is provided with 8 vertically penetrating bolt holes 62*b* at equal circumferential pitches of 45 degrees. Therefore, the flange 62*a* is superimposed on the top flange 51 of the link support 5 and the bolts 59 are passed through the bolt holes 53 and 62*b* of the two members and fastened with nuts 58 (FIG. 4).

The top end of the inner ring 61 is also integrally formed with a flange 61*a* projecting radially inward and this flange 61*a* is formed with 12 bolt holes 61*b* at equal circumferential pitches of 30 degrees. The link holder 2 is set on this flange 61*a*.

Figure 7A:
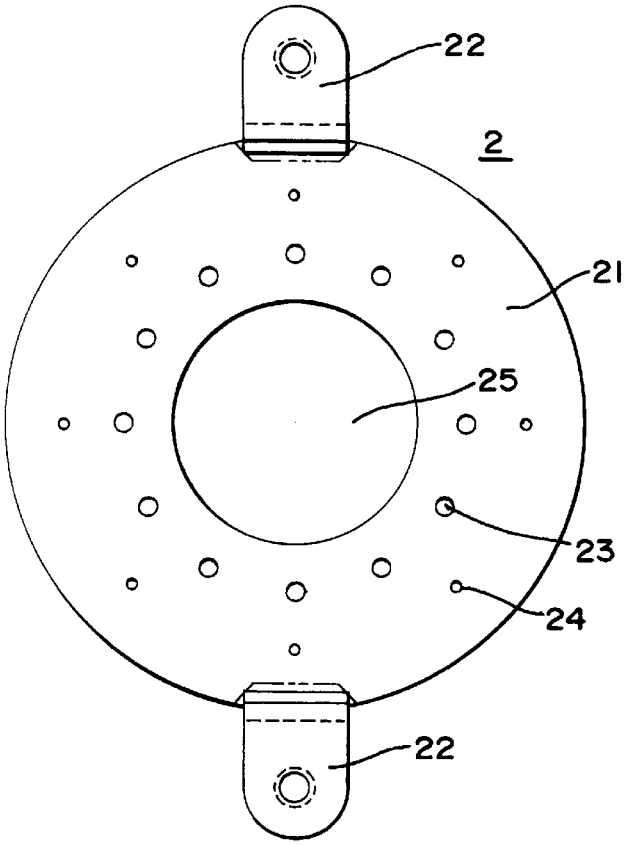
FIG. 7 shows the link holder of the linkage system illustrated in FIG. 2, wherein (*a*) is a plan view and (*b*) is a front view in partial section.
Figure 7B:
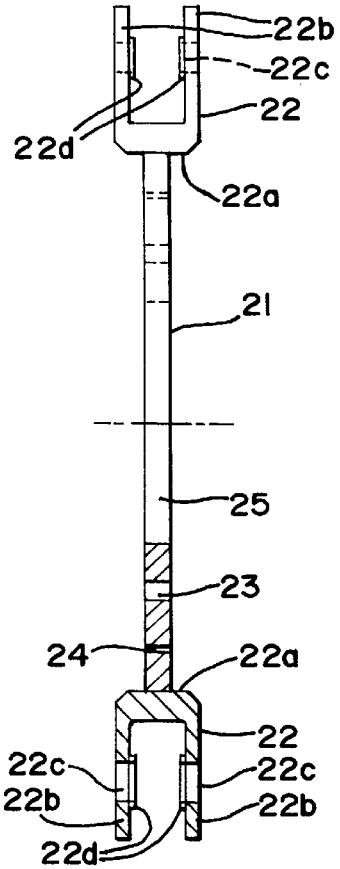

FIG. 7 shows the link holder 2, wherein (*a*) is a plan view and (*b*) is a front view in partial section.

The link holder 2 comprises a discoid holder body 21 and a couple of brackets 22, 22 rigidly secured to both ends thereof.

The holder body 21 is a discoid element with a diameter substantially equal to the outer diameter of the link support 5 and provided with bolt holes 23 corresponding to the bolt holes 61*b* formed in the flange 61*a* of the inner ring 61 of said ball bearing 6. Thus, in this embodiment, the holder body 21 is provided with 12 bolt holes 23 at equal circumferential pitches of 30 degrees. Moreover, this holder body 21 is provided with 8 screw holes 24 at equal circumferential pitches of 45 degrees and radially outwardly of said bolt holes 23.

The right and left brackets 22, 22 are of the same shape. The base end 22*a* of each bracket is welded to the corresponding edge of the holder body 21. In this arrangement, the upper and lower shanks 22*b*, 22*b* of the bracket 22 project transversely outward from the corresponding edge of the link holder body 21. The upper and lower shanks 22*b*, 22*b* of the bracket 22 are respectively provided with vertically penetrating pin holes 22*c*, 22*c*. The pin holes 22*c*, 22*c* formed in the upper and lower shanks 22*b*, 22*b*, respectively, are in alignment and extending through adjusting plates 22*d*, 22*d* disposed on the vertically inner sides of the shanks (the lower side of the upper shank and the upper side of the lower shank).

The link holder 2 is superimposed on the upper surface of the flange 61*b* of the inner ring 61 of said ball bearing 6 and secured in position with bolts 69 passed through the bolt holes 23, 61*b* of the two members and fastened with nuts 68 (FIG. 4), whereby the link holder 2 is supported in such a manner that it may freely rotate about the vertical centerline of the coach.

The top surface of the link holder 2 secured to the ball bearing 6 is provided with a water protector 20 as illustrated in FIG. 4. This water protector 20 is positioned so as to cover a round orifice 25 in the center of the link holder 2 and secured to a holder 21 by screws set in the screw holes 24 formed therein.

Figure 8A:
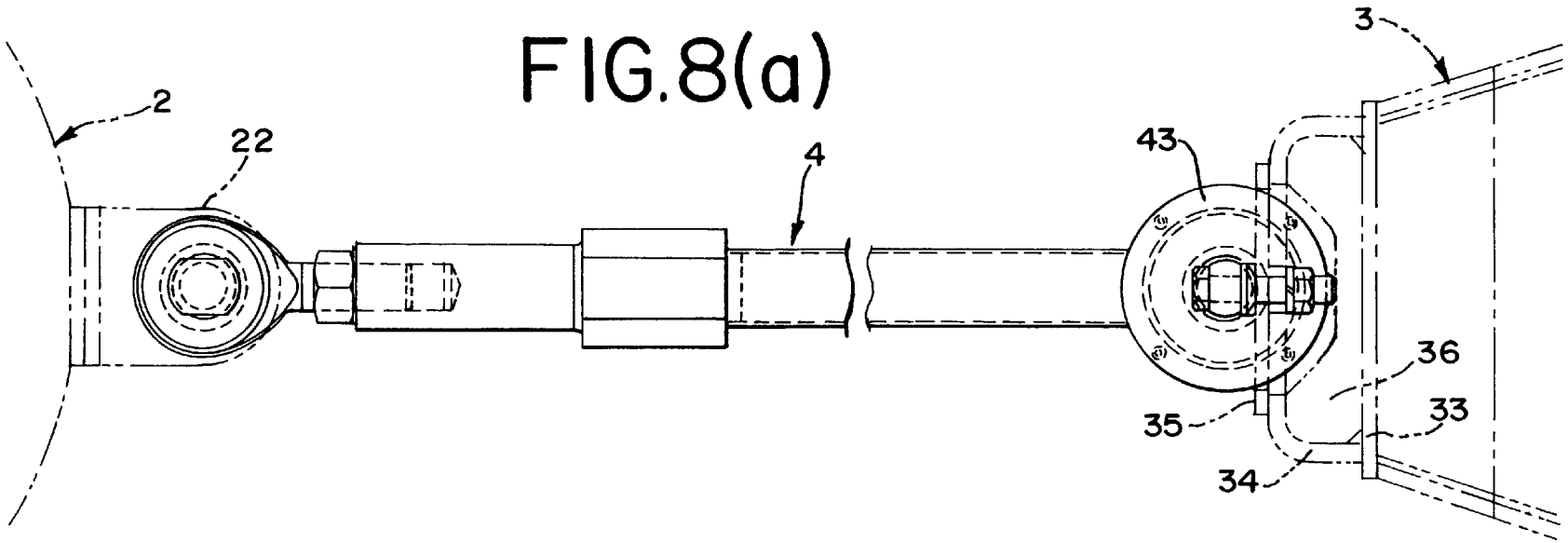
FIG. 8 shows the manner of connection of the link holder and link bracket by the connecting rod in the linkage system illustrated in FIG. 2, wherein (*a*) is a plan view and (*b*) is a side elevation view.
Figure 8B:
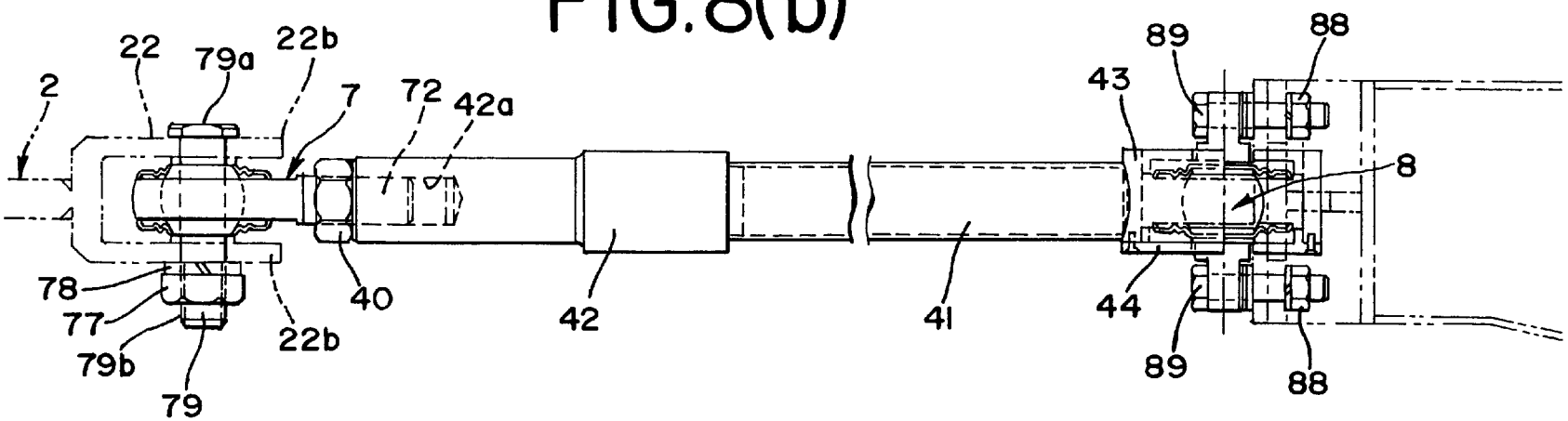

FIG. 8 shows the bracket 22 of the link holder 2, the link bracket 3, and the connecting rod 4 interconnecting them, wherein (*a*) is a plan view and (*b*) is a side elevation view.

Connected to each bracket 22 of the link holder 2 through the first spherical bearing 7 is one end of the corresponding connecting rod 4, with the other end of the connecting rod 4 being connected to the link bracket 3 of coach B or A through the second spherical bearing 8.

Figures 9A, 9B, 10A, 10B, 10C:
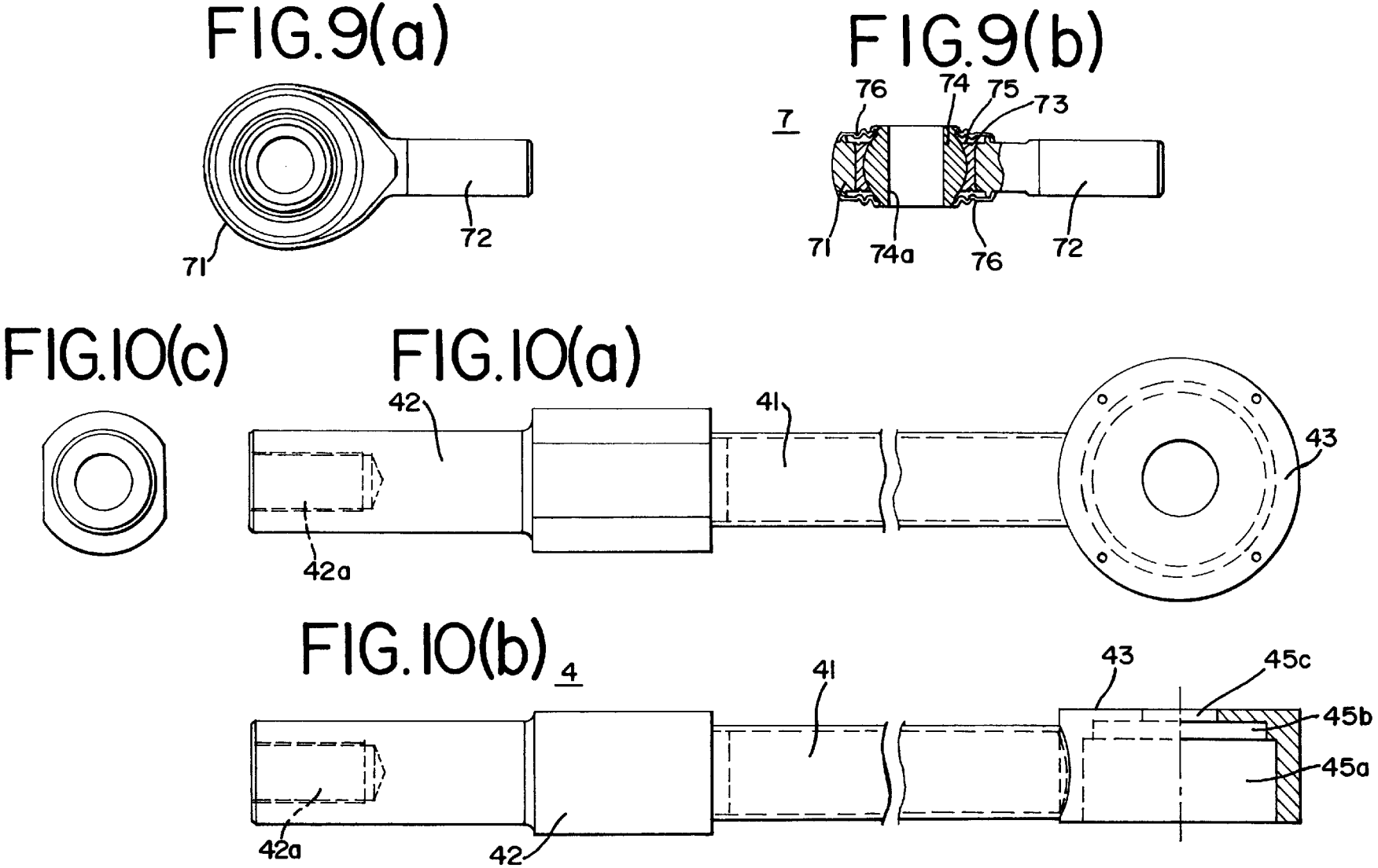
FIG. 9 shows the first spherical bearing of the linkage system illustrated in FIG. 2, wherein (*a*) is a plan viewed and (*b*) is a side elevation view in partial section.
FIG. 10 shows the connecting rod of the linkage system illustrated in FIG. 2, wherein (*a*) is a plan view and (*b*) a side elevation view in partial section.

FIG. 9 shows the first spherical bearing 7, wherein (*a*) is a plan view and (*b*) is a side elevation view in partical section.

This first spherical bearing 7 comprises a generally cylindrical body 71 integrally formed with a bolt portion 72 projecting forward from the front end thereof.

A ball 74 is disposed through a race 73 in a round hole formed in the center of said body 71.

The race 73 is a cylindrical member having a spherically formed inner peripheral surface (arcuate in section) and is disposed with its outer periphery fitted into the round hole of the body 71.

The ball 74 is a cylindrical element having a circular pin hole 74*a* extending vertically therethrough in its central position and a spherical outer peripheral surface complementary to the inner peripheral surface of said race 73. The ball 74 is thus fitted against the inner peripheral wall of the race 73 through a liner 75 interposed therebetween. In this manner, the ball 74 is free to rotate with respect to the race 73. At the upper and lower ends, respectively, of the bearing body 71, a seal 76 is interposed between the ball 74 and the bearing body 71 around the round hole.

The first spherical bearing 7 is disposed with its body 71 inserted between the upper and lower shanks 22*b*, 22*b* of the bracket 22 of said link holder 2 and a pin 79 passed through the pin holes 22*c*, 74*a* in said bracket 22 and ball 74. The pin 79 has a head 79*a* at its upper end and a thread 79*b* cut in its lower end portion. The pin is inserted through the upper shank of bracket 22, passed through the pin hole 74*a* in the ball 74 of the first spherical bearing 7, and fastened by a nut 77 through a spring washer 78 below the lower shank of bracket 22. In this manner, the body 71 of the first spherical bearing 7 is supported rotatably about the pin 79. One end of said connecting rod 4 is connected to the bolt portion 72 integral with said bearing body 71.

FIG. 10 shows the connecting rod 4, wherein (*a*) is a plan view and (*b*) is a side elevation view in partial section.

The connecting rod 4 comprises an elongated cylindrical body 41 and a stepped bar-shaped connector 42 rigidly secured to one end of said body 41, and a generally cylindrical outer tube 43 rigidly secured to the other end of the body 41.

The connector 42 has a bolt hole 42*a* open at one end thereof and said body 41 is connected to the other end.

The outer tube 43 is a cylindrical member open in the downward direction and, as shown in FIG. 8, its lower end is adapted to accept the cap 44.

Figure 11A:
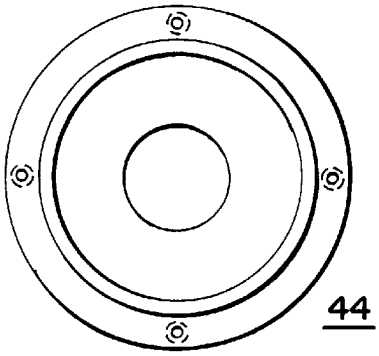
FIG. 11 shows the cap of the outer tube of the connecting rod illustrated in FIG. 10, wherein (*a*) is a plan view and (*b*) is a side elevation view in partial section.
Figure 11B:
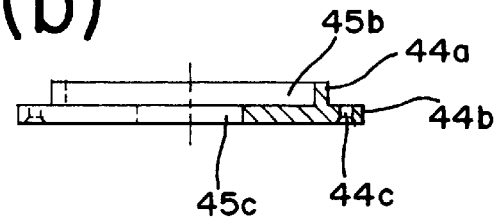

FIG. 11 shows the cap 44 on the outer tube 43 of the connecting rod 4, wherein (*a*) is a plan view and (*b*) is a side elevation view in partial section.

The cap 44 is a stepped disk-shaped member with its upper small-diameter part 44*a* being dimensioned to fit the bottom end opening of the outer tube 43. The lower large-diameter part 44*b* is formed with 4 screw holes 44*c* at equal circumferential pitches of 90 degrees. Therefore, the cap 44 can be attached to the outer tube 43 by fitting said small-diameter part 44*a* into the bottom opening of the outer tube 43 and threading screws through the screw holes 44*c* in the large-diameter part 44*b* into the bottom end opening of the outer tube 43.

In the condition of the outer tube 43 fitted with the cap 44, stepped columnar spaces 45*a*~45*c* are defined in the interior of the outer tube 43. Thus, a large-diameter space 45*a* is formed in the vertically central zone, intermediate-diameter spaces 45*b*, 45*b*, which are slightly reduced in diameter, are formed in the upper and lower sides of said large-diameter space 45*a*, and small-diameter spaces 45*c*, 45*c* are formed in the vertically outwardly of said intermediate-diameter space 45*b*. The small-diameter space 45*c* extends through the upper edge of the outer tube 43 and the lower end of the cap 44.

The connecting rod 4 is installed with the bolt hole 42*a* in the connector 42 being threaded onto the bolt portion 72 of the first spherical bearing 7 and fastened against loosening with the nut 40. In this manner, the connecting rod 4 is allowed to rotate freely with respect to the link holder 2 through the first spherical bearing 7.

The other end of the connecting rod 4 is rotatably mounted on the link bracket 3 through the second spherical bearing 8 attached to the outer tube 43.

Figure 12A:
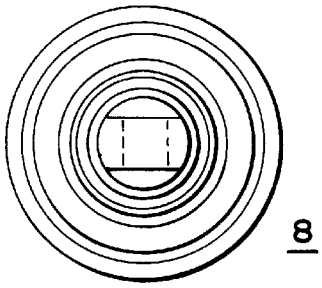
FIG. 12 shows the second spherical bearing of the linkage system illustrated in FIG. 2, wherein (*a*) is a plan view and (*b*) is a front view in partial section.
Figure 12B:
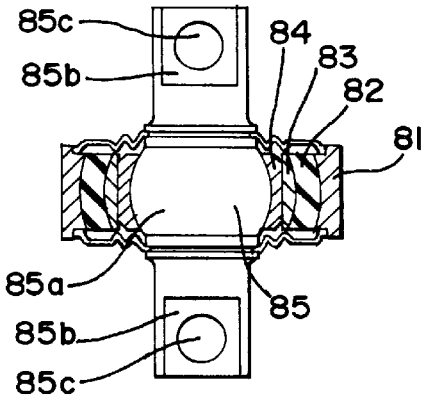
Figure 13A:
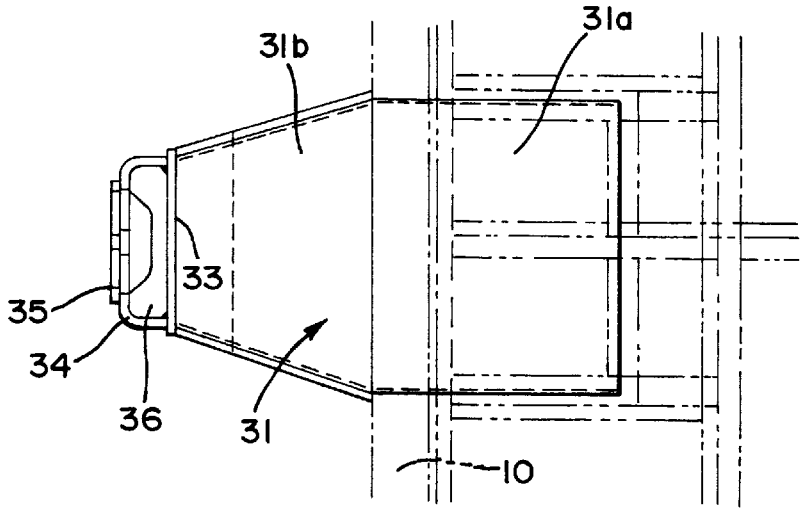
FIG. 13 shows the link bracket of the linkage system illustrated in FIG. 2, wherein (*a*) is a plan view, (*b*) a side elevation view, (*c*) a cross-section view taken along the line B—B, (*d*) a cross-section view taken along the line C—C, and (*e*) an adjusting plate.
Figure 13B:
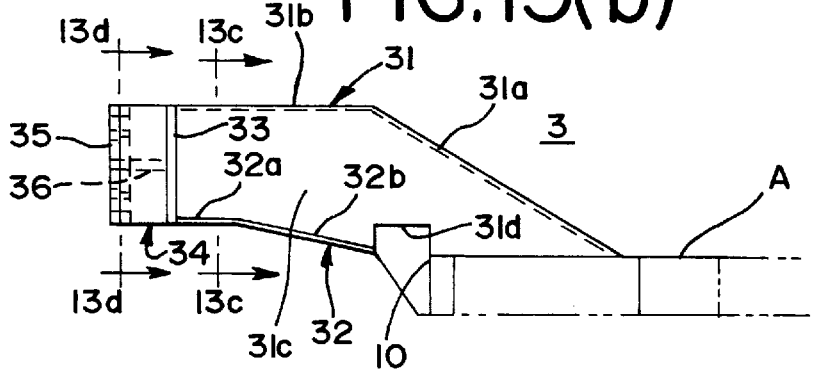
Figure 13E:
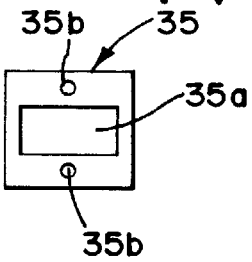
Figure 13D:
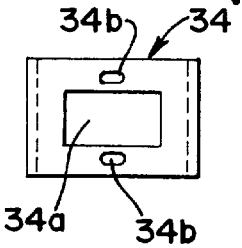
Figure 13C:
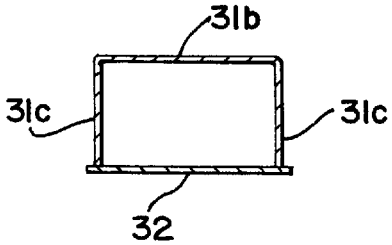

FIG. 12 shows the second spherical bearing 8, wherein (*a*) is a plan view and (*b*) is a front view in partial section.

This second spherical bearing 8 comprises a cylindrical outer ring 81 and a ball 85 installed in the center of said outer ring 81 through a vibroisolating rubber 82, a sleeve 83, and a race 84.

The outer ring 81 is a generally cylindrical member having a spherically formed inner peripheral surface. The outer diameter of the outer ring 81 is dimensioned to fit the large-diameter space 45*a* formed in the outer tube 43 and the vertical dimension of the outer ring 81 coincides with the vertical dimension of the large-diameter space 45*a* of the cavity formed in the outer tube 43 in the condition of the outer tube 43 closed with the cap 44.

The vibroisolating rubber 82 is formed as a generally cylindrical member such that its outer peripheral surface fitting the inner peripheral wall of the outer ring 81 and its inner peripheral surface is also generally cylindrical. The rubber 82 is thus fitted into the outer ring 81.

The sleeve 83 is a generally cylindrical member having an outer peripheral surface fitting the inner peripheral wall of the vibroisolating rubber 82 and a planar inner peripheral surface. It is fitted against the vibroisolating rubber 82.

The race 84 is a generally cylindrical member having a planar outer peripheral surface and a spherical inner peripheral surface.

The ball 85 comprises a central body 85*a* formed as a sphere fitting the inner peripheral wall of the race 84 and, as integrally formed with said body 85*a*, attaching members 85*b*, 85*b* for attachment to the link bracket 3. The attaching member 85*b* is a plate-shaped member formed by cutting off the front and rear portions of a bar and is provided with a bolt hole 85*c* extending in the longitudinal direction of the car.

The second spherical bearing 8 is attached to the outer tube 43 provided at the other end of the connecting rod 4 as illustrated in FIG. 8.

Specifically, the outer ring 81 of the second spherical bearing 8 is fitted into the large-diameter space 45*a* in the outer tube 43 and the cap 44 is fixed to the lower end of the outer tube 43. Since the outer diameter of the outer ring 81 is complementary to the large-diameter space 45*a* in the outer tube 43, the second spherical bearing 8 is radially positioned. Moreover, the bearing 8 is positioned in the vertical direction as well between the upper side of the large-diameter space 45*a* in the outer tube 43 and the upper end of the small-diameter part 44*a* of the cap 44. With the second spherical bearing 8 attached to the connecting rod 4, the attaching member 85*b* of the ball 85 of the second spherical bearing 8 is projecting vertically outward from the outer tube 43 or the small-diameter space 45*c* of the cap 44. The attaching member 85*b* of the spherical bearing 8 is connected to the link bracket 3 secured to coach B or A.

FIG. 13 shows the link bracket 3, wherein (*a*) is a plan view, (*b*) is a side elevation view, (*c*) is a cross-section view taken along the line B—B, (*d*) is a cross-section view taken along the line C—C, and (*e*) shows the adjusting plate.

The link bracket 3 is equipped with a bracket-shaped top plate 31 which is downwardly open. As illustrated in FIG. 13(*a*), the top plate 31 has a forward part 31*a* which is rectangular in plan view and a rear part 31*b* which is trapezoidal with a gradual decrease in width. Moreover, as shown in FIG. 13(*b*), the upper surface of the top plate 31 includes a rear surface 31*b* which is horizontal and a forward surface 31*a* which is gradually inclined in the forward direction. The lower edges of the right and left bent members 31*c* of the top plate 31 are horizontal at forward and rear end portions and the intermediate portion between said end portions is downwardly inclined in the forward direction.

A bottom plate 32 is set against the bottom edges of the rear horizontal parts and inclined parts of the right and left bent members 31*c*, 31*c* of the top plate 31. The bottom plate 32 is also a bent member having a horizontal part 32*a* and an inclined part 32*b* fitting to the lower edge of the bent member 31*c*.

The bent member 31*c* of the top plate 31 is formed with a generally rectangular, downwardly open groove 31*d* in the position corresponding to the forward edge of the inclined part 32*b* of the bottom plate 32.

A rectangular back plate 33 is welded to the rear end edges of the top plate 31 and bottom plate 32.

The rear face of the back plate 33 is fitted with a base plate 34. The base plate 34 is a generally bracket-shaped plate which is open in the forward direction and the transverse open ends are secured by welding to the rear end face of the back plate 33. Formed in the center of the base plate 34 is a rectangular opening 34*a*, with bolt holes 34*b*, 34*b* being provided above and below the opening 34*a* as illustrated in FIG. 13(*d*). The bolt holes 34*b* are provided in the transversely central position and each has a transversely slightly oblong configuration.

The rectangular adjusting plate 35 shown in FIG. 13(*e*) is superimposed on the central rear end surface of the base plate 34 and secured by welding in position. The adjusting plate 35 is formed with a rectangular opening 35*a* and circular bolt holes 35*b*, 35*b* in the positions corresponding to the opening 34*a* and bolt holes 34*b* in the base plate 34. The opening 35*a* of the adjusting plate 35 is slightly smaller than the opening 34*a* of the base plate 34 and the bolt holes 35*b* in the adjusting plate 35, which are circular, are also slightly smaller than the bolt holes 34*b* in the base plate 34.

A reinforcing plate 36 is interposed between the back plate 33 and base plate 34. As illustrated in FIG. 13(*a*), the reinforcing plate 36 is disposed and rigidly secured between the rear end face of the back plate 33 and the inner peripheral surface of the base plate 34. As illustrated in FIG. 13(*b*), the reinforcing plate 36 is horizontally disposed in the vertically center of the back plate 33 and base plate 34. Moreover, the reinforcing plate 36 is cut out in a generally trapezoidal shape in the position facing the openings 34*a*, 35*a* of the base plate 34 and adjusting plate 35.

The link brackets 3 are rigidly secured to the ends of coach B and coach A which are closer to coach C. As illustrated in FIG. 2, each of the forward and rear ends of the coaches is provided with a flange 10 upwardly projecting in a rectangular fashion so that the fitting groove 31*d* of the link bracket 3 is fitted against this flange 10 and welded in position.

Connected to the base plate 34 of the link bracket 3 is the other end of the connecting rod 4. Thus, with a portion of the outer tube 43 of the connecting rod 4 passed into the openings 34*a*, 35*a* of the base plate 34 and adjusting plate 35, the base plate 34 and the other end of the connecting rod 4 are interconnected by bolts and nuts through the bolt holes 34*b*, 35*b* in the base plate 34 and adjusting plate 35 and the bolt hole 85*c* in the attaching member 85*b* of the second spherical bearing B.

In this manner, coach B and coach A are interconnected through coach C by the generally Z-configured running stabilizing linkage system.

The linkage system of the invention is such that the link holder 2 is freely rotatable about the vertical centerline of coach C and one end of each connecting rod 4 is rotatably connected to either end of the link holder 2 through the first spherical bearing 7, with the other end of said connecting rod 4 being rotatably mounted on the link bracket 3 through the second spherical bearing 8. The center of the second spherical bearing 8 is disposed just between coach B and coach C or between coach A and coach C.

Even when the spacing between coach B and coach C and the spacing between coach A and coach C tend to differ from each other, the link holder 2 is caused to rotate by the connecting rod 4 so that coach C is always urged to be positioned in the central position between coach B and coach A. In other words, the relationship between coach B and coach C is immediately translated into the relationship between coach C and coach A through connecting rods 4, 4 and link holder 2 so that coach C is constantly located in the central position between coach B and coach A. Therefore, the jolt of the car, particularly pitching of coach C, can be prevented.

What is claimed is:

1. A three-coach articulated car comprising:

a front coach;

a rear coach;

an intermediate coach which is shorter than said front and rear coaches; and a running stabilizing linkage system connected to said three-coach articulated car having a link holder which is disposed rotatably about a vertical axis of said intermediate coach, a pair of link brackets, one link bracket located on the front coach and the other link bracket located on the rear coach, a pair of connecting rods each rod connected to one of the link brackets at one end and connected to the link holder at the other end so the link holder is at least partially rotatable about a vertical axis.

2. A three-coach articulated car according to claim 1, wherein said link holder is rotatably supported by a ball bearing on top of said intermediate coach.

3. A three-coach articulated car according to claim 1, wherein said link holder has two ends that are transverse to the longitudinal dimension of said articulated car.

4. A three-coach articulated car according to claim 1, wherein one end of said connecting rods is connected to an end of said link holder through a spherical bearing and the other end of each connecting rod is connected to said link brackets through a spherical bearing.

5. A three-coach articulated car according to claim 1, wherein the three-coach articulated car is a low-floor articulated car.

* * * * *